US008485814B2

(12) United States Patent
Jobelius et al.

(10) Patent No.: US 8,485,814 B2
(45) Date of Patent: Jul. 16, 2013

(54) DECORATIVE CANDLE AND METHOD

(75) Inventors: Sherri L. Jobelius, Excelsior, MN (US); Brian T. Paulsen, Excelsior, MN (US)

(73) Assignee: rareEARTH, LLC, Chanhassen, MN (US)

( * ) Notice: Subject to any disclaimer, the term of this patent is extended or adjusted under 35 U.S.C. 154(b) by 417 days.

(21) Appl. No.: 12/872,123

(22) Filed: Aug. 31, 2010

(65) Prior Publication Data

US 2012/0052455 A1 Mar. 1, 2012

(51) Int. Cl.
*F23D 3/16* (2006.01)

(52) U.S. Cl.
USPC ..... 431/288; 264/74

(58) Field of Classification Search
USPC ..... 431/325, 320, 299, 291, 289, 288, 431/126, 199; 425/803; 264/73, 74, 271.1, 264/245, 275, 279, 279.1, 330, 338
See application file for complete search history.

(56) References Cited

U.S. PATENT DOCUMENTS

| | | | | |
|---|---|---|---|---|
| 2,122,451 | A * | 7/1938 | Cassimatis | 264/245 |
| 2,187,053 | A * | 1/1940 | Pratt | 431/126 |
| 4,614,625 | A | 9/1986 | Wilson | |
| 6,063,144 | A | 5/2000 | Calzada et al. | |
| 6,068,472 | A | 5/2000 | Freeman et al. | |
| 6,409,501 | B1 * | 6/2002 | Pappas | 431/289 |
| 6,592,637 | B2 | 7/2003 | McGee et al. | |
| 7,462,205 | B2 * | 12/2008 | Murphy | 44/275 |
| 2002/0024168 | A1 | 2/2002 | Mack et al. | |
| 2002/0098456 | A1 | 7/2002 | Freeman et al. | |
| 2003/0140551 | A1 | 7/2003 | Noda et al. | |
| 2004/0031191 | A1 | 2/2004 | D'Amico et al. | |
| 2004/0068920 | A1 * | 4/2004 | Steele et al. | 44/275 |

FOREIGN PATENT DOCUMENTS

| | | |
|---|---|---|
| KR | 100750205 | 8/2007 |

OTHER PUBLICATIONS

Schadler, Koo. "Organic and Inorganic Pigment Characteristics." Artist's Network. Artist's Network, Web Dec. 12, 2012. http://www.artistsnetwork.com/the-artists-magazine/organic-inorganic-pigments.*

Heller, Beatrice. Candlemaking, A Set-by-Step Guide. New York City: Nash Publishing, 1972.*

* cited by examiner

*Primary Examiner* — Kang Hu
*Assistant Examiner* — Vivek Shirsat
(74) *Attorney, Agent, or Firm* — Nikolai & Mersereau, P.A.; C. G. Mersereau

(57) ABSTRACT

A decorative molded candle and method of making the candle is disclosed in which coloring agents are limited to the outer peripheral surface of the candle.

16 Claims, 1 Drawing Sheet

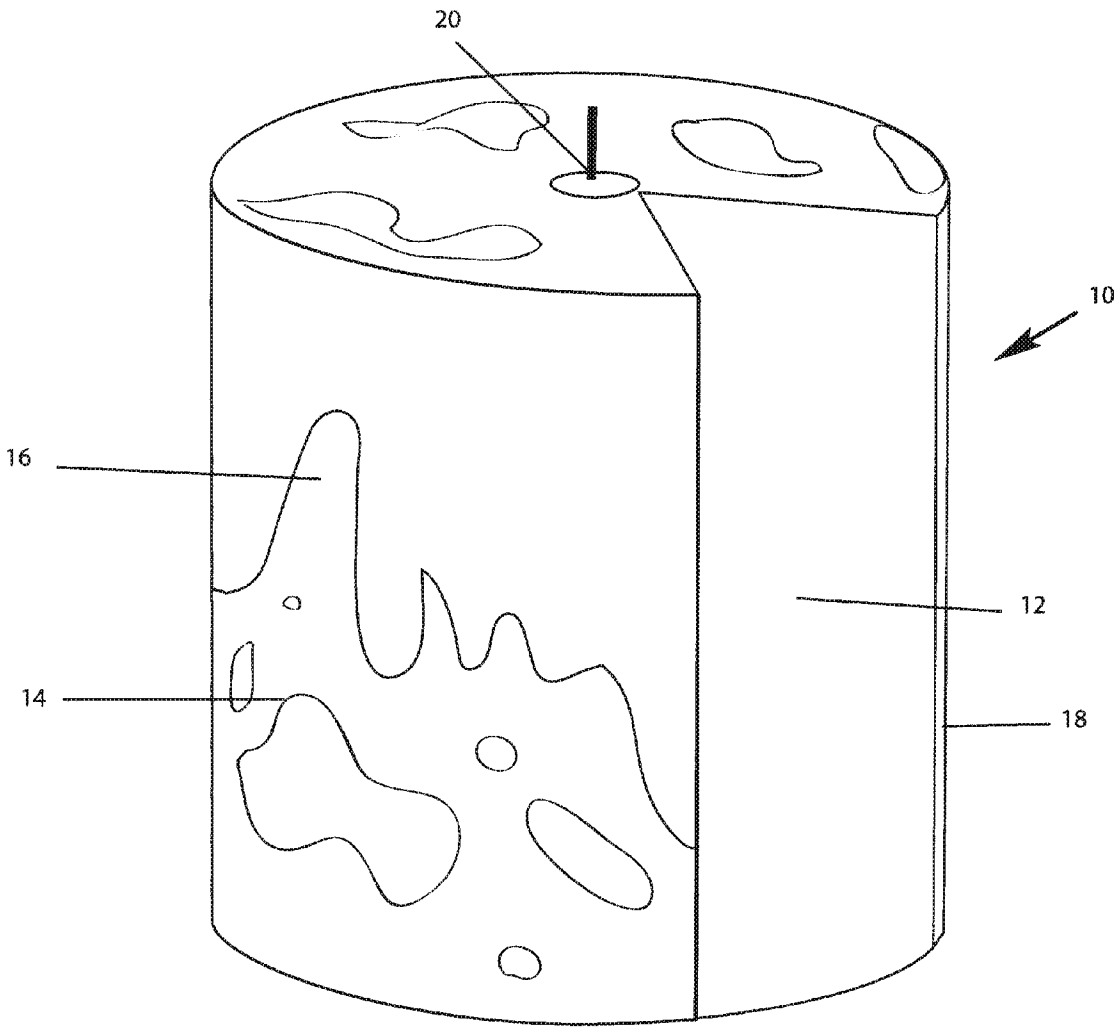
10
20
16
12
14
18

DECORATIVE CANDLE AND METHOD

CROSS-REFERENCED TO RELATED APPLICATIONS

Not applicable

STATEMENT REGARDING FEDERALLY SPONSORED RESEARCH OR DEVELOPMENT

Not applicable

BACKGROUND OF THE INVENTION

I. Field of the Invention

The present invention relates generally to decorative candles and, more particularly, to a method of imparting decorative coloration to candles which enables the use of environmentally friendly dyes, including natural mineral coloring agents or pigment dyes for coloration, in combination with paraffin and non-paraffin candle material such as beeswax or vegetable waxes.

II. Related Art

Candles have long been used for illumination and so techniques for producing candles have been practiced for many centuries. More recently, candles have no longer been necessary for lighting, but they have enjoyed a popularity as decorative accents in many circumstances and they are now produced in a variety of shapes and sizes, many of which are formed using molds. Candles are also made from a variety of combustible materials. These include refined petroleum-based hydrocarbon paraffin wax, various tallow materials including stearic acid components made from animal fats, beeswax, a variety of hydrogenated vegetable oils such as palm oil and coconut oil, soy oil and mineral oil gels. Such combustible materials for non-paraffin candles are described, for example, in U.S. Pat. No. 6,063,144.

Candles are generally formed by imbedding a wicking material in a stable combustible composition having a relatively low melting point and allowing the wicking material to protrude from the combustible composition. Once the wick is lit, the resulting heat causes the adjacent exposed combustible composition to melt. The melted composition proceeds to move up the wick where it is consumed. This well-known phenomenon in which liquids tend to move uphill through porous materials is known as capillary action or "wicking" and this enables the candle to burn continuously consuming melted combustible material as it moves up the wick. Thus, necessary characteristics of a combustible composition of a candle include that of a relatively low melting point and satisfactory wicking properties for proper burning.

With the rise of the popularity of candles as decorative accents, it has also become popular to add coloring agents or dyes to the combustible candle material in order to achieve a decorative effect. Heretofore, the coloring agents or dyes available to candle makers have been limited to synthetic and oil soluble materials, most of which are petroleum or coal-tar based and, while they are compatible with most combustible candle compositions, they may also be toxic in vapor form or if ingested. Natural water-based dyes or food coloring-type colorants do not dissolve or disperse in waxes and therefore, are impractical for use in candles.

Toxic effects may be avoided by using natural, mineral-based coloring agents or pigments to add a colorant to a candle. Typically, colorants or dyes have been added to the wax prior to pouring the wax into a candle mold, with the colorant or dye dispersed generally evenly in the melted wax.

However, it has been found that benign coloring agents such as natural mineral pigments, while advantageous in many ways, if dispersed in the melted wax, tend to interfere with the natural capillary action of the wax at the wick and so reduce or eliminate the wicking effect necessary for the burning of the candle. This, of course, has precluded the use of such materials as it prevents proper burning of the candle and thereby renders it useless for the intended purpose. Thus, the desirability of manufacturing candles using non-toxic and environmentally friendly coloring agents remains. It would be desirable if one could make decorative candles colored by, for example, natural mineral pigments, that avoid interference with the natural wicking process and enables such candles to burn normally.

SUMMARY OF THE INVENTION

The present invention provides a process for producing decorative candles using natural pigments as coloring agents which avoids wicking problems previously associated with the use of mineral-based pigments, or the like, dispersed in the wax or other combustible candle composition. The process is particularly useful in making molded candles and involves limiting the location of the decorative pigment to the outer portion of the candle, and preferably, the outer surface of the candle, thereby preserving the decorative effect throughout the burning life of the candle without inhibiting the burning process.

The candle making process may be used with any suitable candle mold and involves applying a wetting agent, preferably a candle mold release material to the interior surface of the mold, which may involve applying a thin layer of a silicone-based release material to the wall or walls of the mold. An amount of any desired coloring agent or pigment or a plurality of such agents or pigments in finely divided dry or powdered form is then applied to the interior surface of the mold which has been wetted with the release material. It will be appreciated that any powdered dye or pigment material, including natural and synthetic coloring agent, can be used in accordance with the process. The powdered pigment material may be applied in a pattern or it can be randomly distributed by adding a small amount of powdered pigment to the mold, as by shaking from a source, and thereafter tapping or turning the mold to spread the powdered pigment about the interior of the mold. By distributing powdered pigments in different locations on the mold walls and using different combinations of colored pigments, a variety of effects and color combinations can be achieved.

Melted wax or other low melting point combustible candle composition is then poured into the mold at the recommended pouring temperature of the specific material being used. The mold containing the poured wax is then, allowed to cool and thereafter, the molded candle can be removed from the mold. The colorant pattern is captured in the outer surface of the molded candle.

As has long been customary in the candle-making art, a wick may be either suspended and secured in the mold prior to the pouring of the candle or a hole can be drilled in the molded candle and the wick inserted and secured there later. All of these techniques are well known in the art and need no further explanation, as they do not affect the decorative nature or operation of the candle.

The present invention further includes candles made by the process. These candles generally exhibit a random outer color pattern that is unique and that varies about the outside of the candle and varies along the length of the candle. This imports a colorful uniqueness to each candle produced such that no two candles are identical even though the same color combination may be used. A fragrance may also be added to the combustible candle composition, if such an effect is to be used in addition to coloring.

BRIEF DESCRIPTION OF THE DRAWINGS

In the drawings:

FIG. 1 depicts a candle made by the process of the present invention with parts cut away to show details.

DETAILED DESCRIPTION

The following detailed description describes one or more embodiments of the concept of the present invention, however, the embodiments are presented as examples only and are not intended to limit the scope of the invention in any manner.

An aspect of the present invention is to produce a candle having a decorative exterior appearance in which the decorative coloration is substantially limited to the outer surface of the candle. It has been found that any powdered dye or pigment material or synthetic compatible with a particular combustible candle composition can be used. The present concept is particularly well suited to creating an external appearance using natural or naturally derived coloring agents or pigments that are non-toxic. These may be derived from minerals such as metal oxides, or the like, which have not been compatible with candles made by earlier candle-making processes. The ability to incorporate other natural or naturally derived pigments in the creation of a decorative candle further enables the manufacture of a candle entirely of naturally occurring or non-toxic ingredients including both the combustible candle composition and the additive colorant and/or fragrances which may also be added to the candle.

The decorative candles produced in accordance with the present invention are manufactured by a unique process of candle molding. The process also enables the production of decorative candles using any desired dyes or pigments including, but no limited to, natural mineral-based pigments in combination with many types of combustible candle compositions without encountering the wicking problems formerly associated, for example, with the use of mineral-based pigments.

The process of the present invention is one for producing molded candles which may be of any shape and which may be produced using molds of any mold material including metal molds such as those made of steel, which may be plated, aluminum or non-metal materials such as plastics or rubber-based molds in the shape of the finished candle.

In accordance with the process, the interior surface of a selected mold is subjected to a wetting step in which a wetting material, generally a candle mold release spray type material such as those containing a silicone, is applied to the interior surfaces of the mold as by spraying, or the like such that the surface remains wet. In this manner the surface is receptive to finely divided or powdered type coloring agents or pigments which may be applied to the wetted surface in any manner desired. Thus, any desired number of coloring agents or pigments may be added in any desired manner. One technique involves shaking an amount of a pigment or pigments into the mold and then tapping or turning the mold to spread the powdered pigment on the mold wall. Thus, more than one pigment can be added sequentially or a number of pigments can be combined and then applied together to the interior of the mold. In addition, if desired, one or more pigments can be added to various areas of the mold to create a desired pattern. It will be appreciated that distributing the powdered pigments in different locations in the mold walls and using different combinations of colored pigments enables the candle maker to achieve a variety of effects and color combinations distributed about the interior of the mold.

Once the mold is prepared in the manner indicated, with the powdered pigments adhering to the wetted surface of the interior of the mold, an amount of the flowable combustible candle composition can then be poured into the mold to create the actual candle. In this manner, it has been found that any compatible combustible candle composition can be used to form the body of the candle itself. Specifically, candle wax formulations using natural beeswax, plant wax formulas such as hydrogenated vegetable oils including palm oil, coconut oil and soy oil can be used. In addition, various tallow materials including stearic acid components from animal fats and even mineral oil gels can be used. Of course, petroleum-based hydrocarbon paraffin wax can also be used in the candles of the invention. It will be appreciated, however, that the use of non-petroleum based materials in combination with natural mineral-type coloring agents or pigments enables the production of an entirely non-toxic and environmentally friendly or "green" candle.

Once the poured candle material is allowed to cool, the candle can be removed from the mold. It has been found that using the process of the present invention, the pattern of coloring agents adheres to and is dispersed in the very surface of the finished candle such that it remains for the life of the candle and, in the case of colorant materials which might interfere with the wicking process during burning of the candle, these remain remote from the burning process. It should further be noted that if small amounts of interfering colorants do reach the wick of the candle, these remain in concentrations too low to interfere with the wicking process and the consumption of the candle. Thus, the term "substantially at the outer surface" when referring to the presence of the one or more coloring agents in the candles of the invention, allows for the fact that there may be minute amounts of the colorant that do travel into the melted combustible candle composition during the molding or burning of the candle.

In addition, as indicated, there can be an amount of an agent imparting a fragrance to the candle added to the combustible candle composition to add the accent of a scented candle to the final product.

In the candle-making process, a wick can be suspended with respect to the mold at the time the melted combustible candle composition is added to the mold so that the wick itself is molded into the candle or the wick can be added after the candle has been molded in accordance with wicking addition steps well known to those skilled in the art.

In addition to avoiding the possible problems associated with the presence of coloring agents throughout the candle wax or other combustible candle composition, the process of the present invention enables candles to be produced using a minimum amount of such coloring agents as they need not be dispersed throughout the candle or even partway into the candle.

In FIG. 1 there is shown a candle made by the process of the present invention with parts cut away to show details. The candle is shown generally at 10 and includes an interior composition of wax or other combustible candle material at 12 and exterior coloration such as that shown at 14 and 16 which is contained in a very thin layer 18 at the surface of the candle which is actually thinner in proportion to the size of the candle in that shown in the figure. A wick is shown at 20.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. A method of producing a candle having a decorative outer surface pattern comprising:

(a) providing a mold container having a bottom and sidewall for defining a mold cavity having a desired candle shape;

(b) dispensing into said cavity a wetting agent material wherein said wetting agent is a candle mold release spray containing silicone to form a coating thereof on the surface of said cavity;

(c) dispensing into said cavity an amount of at least one coloring agent in finely divided form in a manner such that at least a portion of said at least one coloring agent is retained in said mold by said wetting agent;

(d) molding a candle by dispensing an amount of a flowable combustible candle composition into said cavity to form a molded candle and allowing it to cool; and (e) wherein an amount of said coloring agent retained by said wetting agent is transferred to the outer surface of said molded candle from said mold during said molding thereby providing said molded candle with a decorative outer surface pattern.

2. A method as in claim 1 further comprising providing and positioning a wick in said candle composition at a time selected from before (d) or adding it after (d).

3. A method as in claim 1 wherein said at least one coloring agent is selected from the group consisting of powdered natural and synthetic dyes and pigments, including powdered natural and naturally derived pigments and combinations thereof.

4. A method as in claim 1 wherein the candle composition includes material selected from the group consisting of petroleum-based paraffin wax and naturally occurring fatty acids, waxes and oils.

5. A method as in claim 4 wherein the candle composition includes a material selected from the group consisting of beeswax and vegetable oils.

6. A method as in claim 1 wherein said at least one coloring agent is selected from the group consisting of quarried minerals and metal oxides.

7. A method as in claim 1 wherein (c) includes dispensing a plurality of coloring agents into said cavity.

8. A method as in claim 5 wherein said at least one coloring agent is selected from the group consisting of quarried minerals and metal oxides.

9. A method as in claim 8 wherein (c) includes dispensing a plurality of coloring agents into said cavity.

10. A method as in claim 1 including adding a fragrance to said candle composition.

11. A method as in claim 2 wherein said wick is suspended in said cavity prior to adding said candle composition.

12. A method as in claim 3 wherein said at least one coloring agent includes a synthetic agent.

13. A method as in claim 1 wherein said wetting agent includes a silicone.

14. A method as in claim 1 wherein said surface pattern is random.

15. A method as in claim 1 wherein said surface pattern is distributed around the entire circumference of said candle.

16. A method as in claim 1 wherein said mold is shaken when said at least one coloring agent is added.

* * * * *